US007803126B2

(12) United States Patent
Nan

(10) Patent No.: US 7,803,126 B2
(45) Date of Patent: Sep. 28, 2010

(54) MASSAGE APPARATUS WITH FLEXIBLE MASSAGE ACTUATOR

(75) Inventor: Simon Siu Man Nan, Richmond Hill (CA)

(73) Assignee: Nanma Manufacturing Co. Ltd., Hong Kong (HK)

( * ) Notice: Subject to any disclaimer, the term of this patent is extended or adjusted under 35 U.S.C. 154(b) by 813 days.

(21) Appl. No.: 11/311,768

(22) Filed: Dec. 19, 2005

(65) Prior Publication Data

US 2007/0142754 A1 Jun. 21, 2007

(51) Int. Cl.
*A61H 19/00* (2006.01)
*A61H 21/00* (2006.01)
*A61H 1/00* (2006.01)

(52) U.S. Cl. ..... 601/72; 601/46; 601/84; 601/85; 601/87; 601/94; 128/845; 600/38

(58) Field of Classification Search ..... 601/69, 601/70, 72, 135, 46, 84, 128, 129, DIG. 16, 601/DIG. 20
See application file for complete search history.

(56) References Cited

U.S. PATENT DOCUMENTS

| | | | | | |
|---|---|---|---|---|---|
| 790,929 | A | * | 5/1905 | Smith | 294/74 |
| 1,033,187 | A | | 7/1912 | Metzger | |
| 2,957,474 | A | * | 10/1960 | Bates et al. | 601/135 |
| 3,451,391 | A | * | 6/1969 | Tavel | 601/72 |
| 3,504,665 | A | * | 4/1970 | Bakunin et al. | 601/71 |
| 3,675,898 | A | * | 7/1972 | Fattor et al. | 254/134.3 FT |
| 3,814,085 | A | * | 6/1974 | Kupchinski | 601/122 |
| 4,002,164 | A | * | 1/1977 | Bradley | 601/135 |
| 4,274,612 | A | * | 6/1981 | Massey | 248/74.3 |
| 4,878,489 | A | * | 11/1989 | Kamayachi | 601/72 |
| D361,980 | S | * | 9/1995 | Chen | D13/119 |
| 5,521,022 | A | * | 5/1996 | Petzl | 429/97 |
| 5,611,771 | A | * | 3/1997 | Taylor | 601/70 |
| D384,156 | S | * | 9/1997 | Kain | D24/200 |
| 5,776,119 | A | * | 7/1998 | Bilbo et al. | 604/317 |
| 6,022,328 | A | * | 2/2000 | Hailey | 601/69 |
| 6,037,078 | A | * | 3/2000 | Siu-Man | 429/96 |
| 6,183,427 | B1 | | 2/2001 | Ishii | |
| 6,190,307 | B1 | * | 2/2001 | Tsai | 600/38 |
| 6,280,403 | B1 | * | 8/2001 | Lok | 601/70 |
| 6,632,185 | B2 | | 10/2003 | Chen | |
| 6,758,826 | B2 | | 7/2004 | Luettgen et al. | |

(Continued)

OTHER PUBLICATIONS iFlex iVibe: Tangerine, http://www.sextoysuniverse.com/customer/product/php?productid=710&cat=119&page=1, dated Mar. 29, 2006, 1 page.

(Continued)

*Primary Examiner*—Justine R Yu
*Assistant Examiner*—Clinton Ostrup
(74) *Attorney, Agent, or Firm*—Polsinelli Shughart PC

(57) ABSTRACT

A massage apparatus comprising a main body operatively engaged to one or more massage actuators with one of the massage actuators being engaged to a malleable wire capable of being bent to any orientation and retain that bent orientation relative to the main body is disclosed. A removable battery compartment having a control panel is adapted to be operatively engaged to the main body for controlling the operation of the one or more massage actuators when the removable battery compartment is operatively engaged to the main body of the massage apparatus.

10 Claims, 3 Drawing Sheets

U.S. PATENT DOCUMENTS

| | | | | |
|---|---|---|---|---|
| 6,929,612 | B2 * | 8/2005 | Mangano | 601/71 |
| 7,081,087 | B2 * | 7/2006 | Jannuzzi | 600/38 |
| 2002/0188233 | A1 * | 12/2002 | Denyes | 601/46 |
| 2004/0068213 | A1 * | 4/2004 | Fujisawa | 601/70 |
| 2004/0186344 | A1 | 9/2004 | Jannuzzi | |
| 2006/0069329 | A1 * | 3/2006 | Nan | 601/72 |

OTHER PUBLICATIONS

Techno Flex, http://www.sextoysuniverse.com/customer/product/php?productid=716&cat=119&page=1, dated Mar. 29, 2006, 1 page.

Office Action dated May 28, 2008 regarding U.S. Appl. No. 10/950,935, 6 pages.

Office Action dated Jan. 7, 2009 regarding U.S. Appl. No. 10/950,935, 10 pages.

Office Action dated Dec. 9, 2008 regarding U.S. Appl. No. 11/315,021, 15 pages.

* cited by examiner

MASSAGE APPARATUS WITH FLEXIBLE MASSAGE ACTUATOR

FIELD

The present document relates to a massage apparatus, and more particularly to a massage apparatus having a flexible massage actuator.

SUMMARY

In an embodiment, the massage apparatus comprises a main body, the main body adapted to operatively engage a removable battery compartment, the removable battery compartment including a control panel for controlling the operation of the massage apparatus, and a massage actuator engaged to the main body through a malleable wire, the malleable wire adapted to be bent to any orientation and retain that bent orientation relative to the main body.

In another embodiment, the massage apparatus comprises a main body, the main body adapted to operatively engage a removable battery compartment, the removable battery compartment including a control panel for controlling the operation of the massage apparatus, and one or more massage actuators operatively associated with the control panel for operation of the one or more massage actuators, a one of the one or more massage actuators being operatively engaged to the main body through a malleable wire, the malleable wire adapted for a bent orientation and retain that bent orientation relative to the main body.

In one embodiment, the massage apparatus comprises a main body and at least one massage actuator operatively associated with the main body, the at least one massage actuator being engaged to the main body through a malleable wire, the malleable wire being adapted to be bent to any orientation and retain that bent orientation relative to the main body.

In another embodiment, a method for using the massage apparatus comprises:

a) providing a massage apparatus comprising a main body and at least one massage actuator operatively associated with the main body, the at least one massage actuator being engaged to the main body through a malleable wire, the malleable wire being adapted to be bent to any orientation and retain that bent orientation relative to the main body;

b) applying a force to the malleable wire in order to bend the malleable wire to any orientation; and c) removing the force from the malleable wire such that the malleable wire retains the bent orientation.

Implementations of the above embodiments may include one or more of the following features:

The malleable wire is encased in a flexible tube.

The main body is engaged to a coupling block with the malleable wire being adapted to engage the coupling block.

The malleable wire defines a distal hook and a proximal hook with the distal hook being adapted to be engaged to the vibration massage actuator and the proximal hook being adapted to be engaged to the coupling block.

The vibration massage actuator includes a motor with the motor defining an opening and the opening being adapted to engage a clamping plug.

The distal hook is adapted to be engaged to the clamping plug for engaging the malleable wire to the vibration massage actuator.

The coupling block defines an opening with the opening adapted to be engaged to a first plug and the first plug being adapted to be engaged to a second plug, wherein the first and second plugs collectively engage the proximal hook in a clamping action.

The removable battery compartment comprises a body that defines a plurality of compartments, each of the plurality of compartments adapted to receive a respective battery therein.

The removable battery compartment comprises a control panel with the control panel being adapted to control the operation of the massage apparatus.

The control panel controls the operation of the massage apparatus when the removable battery compartment is operatively engaged to the main body.

The removable battery compartment defines at least one L-shaped slot adapted to engage a protrusion defined by the main body when operatively engaging the removable battery compartment to the main body.

The malleable wire is adapted to be bent to any orientation at room temperature.

The control panel controls the operation of the one or more massage actuators when the removable battery compartment is operatively engaged to the main body.

One of the one or more massage actuators is a vibration massage actuator with the vibration massage actuator being adapted to be placed in the bent orientation by the malleable wire.

One of the one or more massage actuators is a squirmy massage actuator.

The malleable wire is adapted to be bent at the specific orientation at room temperature.

The at least one massage actuator is a vibration massage actuator.

Additional features of the various embodiments will be set forth in the description which follows or will become apparent to those skilled in the art upon examination of the drawings and detailed description which follows.

BRIEF DESCRIPTION OF THE DRAWINGS

Corresponding reference characters indicate corresponding elements among the view of the drawings.

DETAILED DESCRIPTION

Figure 1:
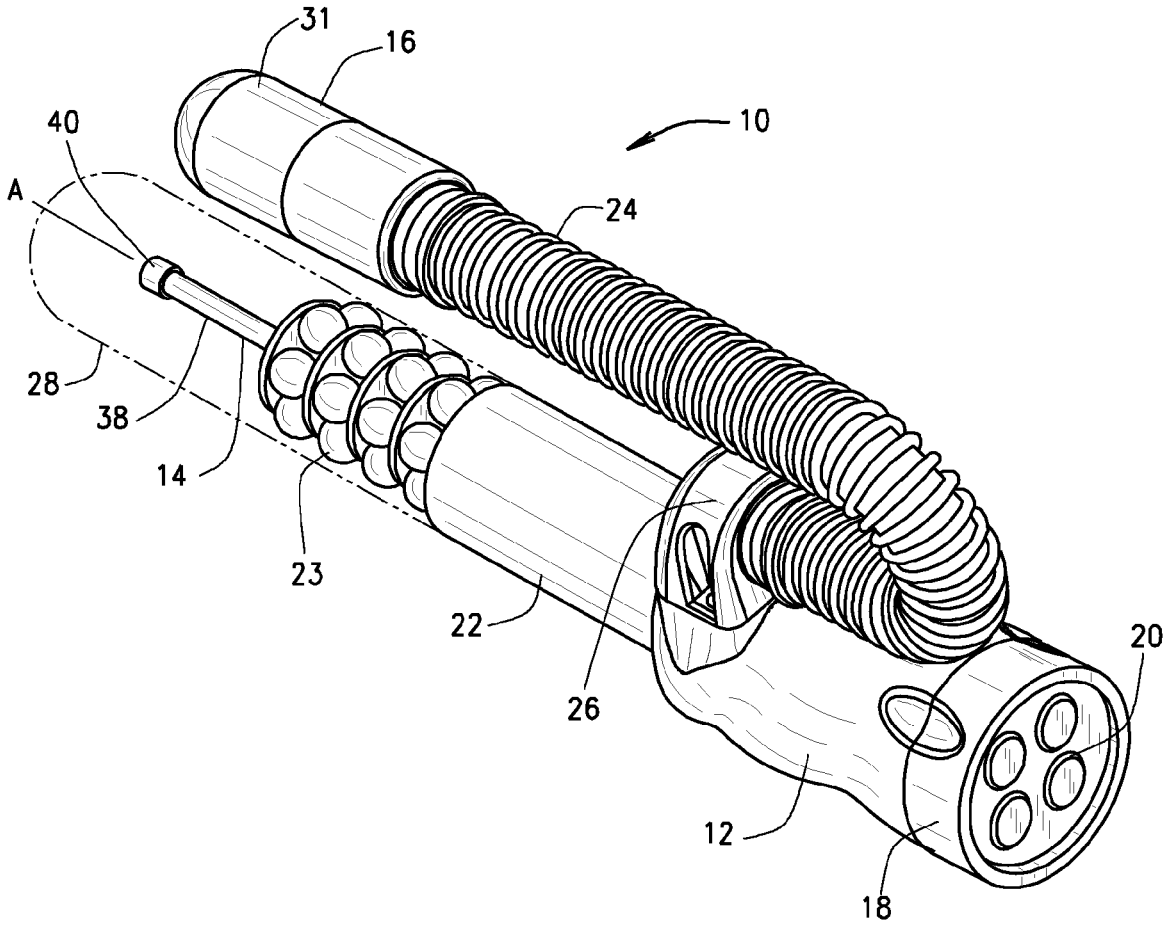
FIG. 1 is a perspective view of the massage apparatus.

Referring to the drawings, an embodiment of the massage apparatus is illustrated and generally indicated as 10 in FIG. 1. The massage apparatus 10 may comprise a main body 12 operatively engaged to a vibration massage actuator 16 that permits the massage actuator 16 to be bent to any orientation and maintain that bent orientation after the bending force is removed. In addition, the main body 12 may be operatively engaged to a removable battery compartment 18 having a control panel 20 for controlling the operation of massage apparatus 10.

Figure 2:
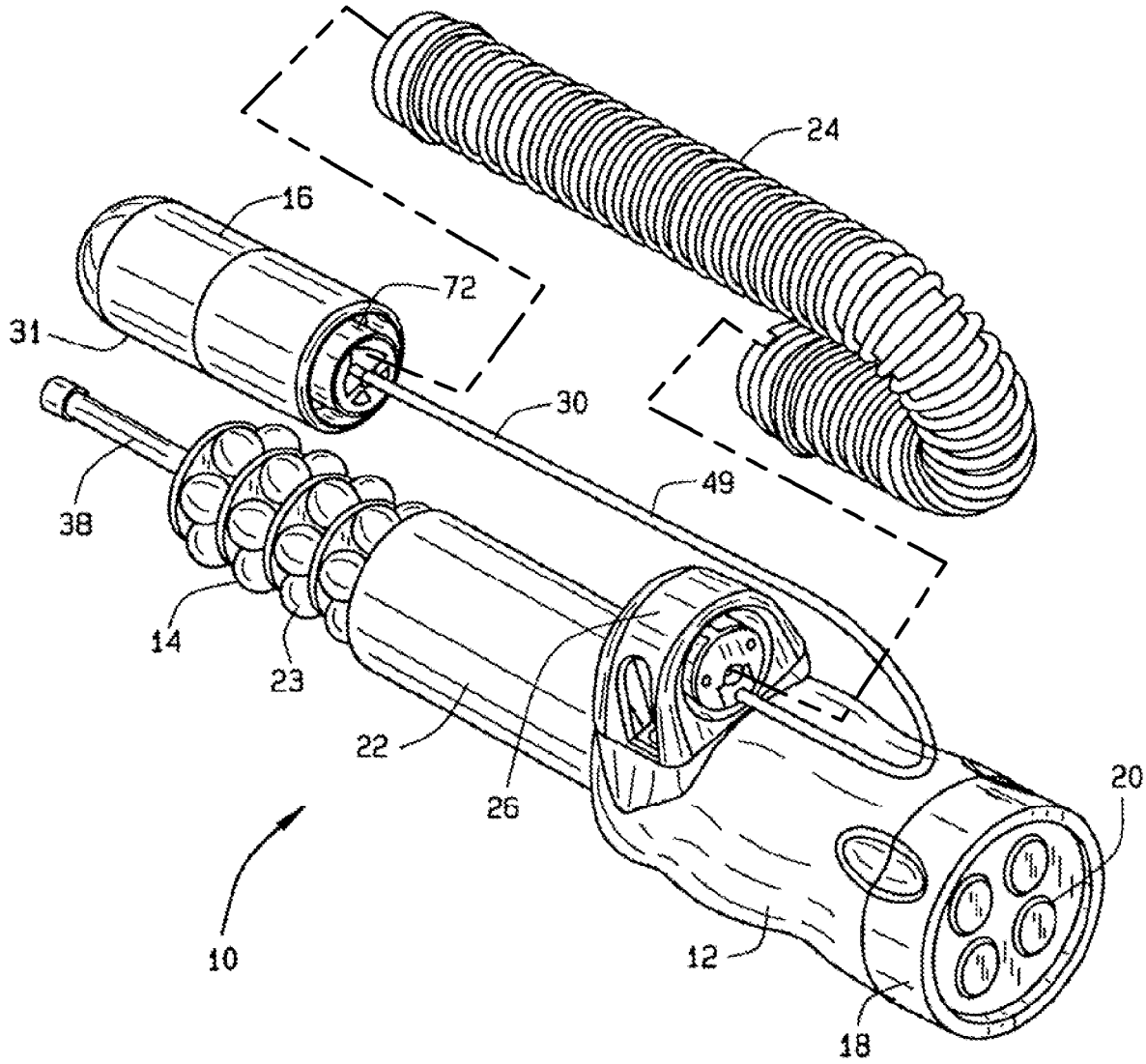
FIG. 2 is a perspective view of the massage apparatus showing a flexible tube in isolation.

Referring to FIGS. 1 and 2, the vibration massage actuator 16 provides a vibration function and may include a motor (not shown) disposed inside a casing 31 that is operatively engaged to an eccentric mass mounted on a motor shaft (not shown) of the motor. In addition, the vibration massage actuator 16 includes a boss 72 adapted for engaging the actuator 16 to the main body 12. Operation of the motor rotates the motor shaft that spins the eccentric mass in a manner that vibrates casing 31. The vibration massage actuator 16 may be engaged to the main body 12 by a malleable wire 30. In one embodiment, the malleable wire 30 may be encased inside a hollow, flexible tube 24 that permits the malleable wire 30 to be bent to any orientation relative to the main body 12. The malleable wire 30 may include a body 49 engaged to a coupling block 26 of the main body 12 at one end and to the vibration massage actuator 16 at the other end thereof. In one embodiment, the body 49 of the malleable wire 30 may be bent by a bending force at room temperature to any bent configuration desired by the user while retaining that bent configuration once the bending force is removed from the malleable wire 30.

As such, the vibration massage actuator 16 may be oriented to any bent configuration or orientation as desired by the user by simply bending the flexible tube 24 which forces the malleable wire 30 into a bent orientation. Once the user removes the bending force, the vibration massage actuator 16 retains that bent orientation relative to the main body 12. Power is provided to the vibration massage actuator 16 by electric wires (not shown) that are encased inside flexible tube 24 and are operatively associated with the control panel 20 and the removable battery compartment 18 for controlling the operation of actuator 16.

In addition, the main body 12 may be operatively associated with a squirming massage actuator 14 that provides a squirming action. The squirming massage actuator 14 may include a driving unit 22 that operates a gear assembly 23 such that rod 38 having a distal end 40 rotates along an axis A. The rotating action of the rod 38 and the fact that axis A is slightly off center relative to the true axis of main body 12 generates a squirming action such that an engageable and resilient outer sleeve 28 (shown in phantom) that may encase the squirming massage actuator 14 will vibrate as the squirming vibrating action is imparted to the outer sleeve 28. In one embodiment, the driving unit 22 may be a motor (not shown) operatively engaged to rotate rod 38; however, other driving means for rotating rod 38 are contemplated.

Figure 3:
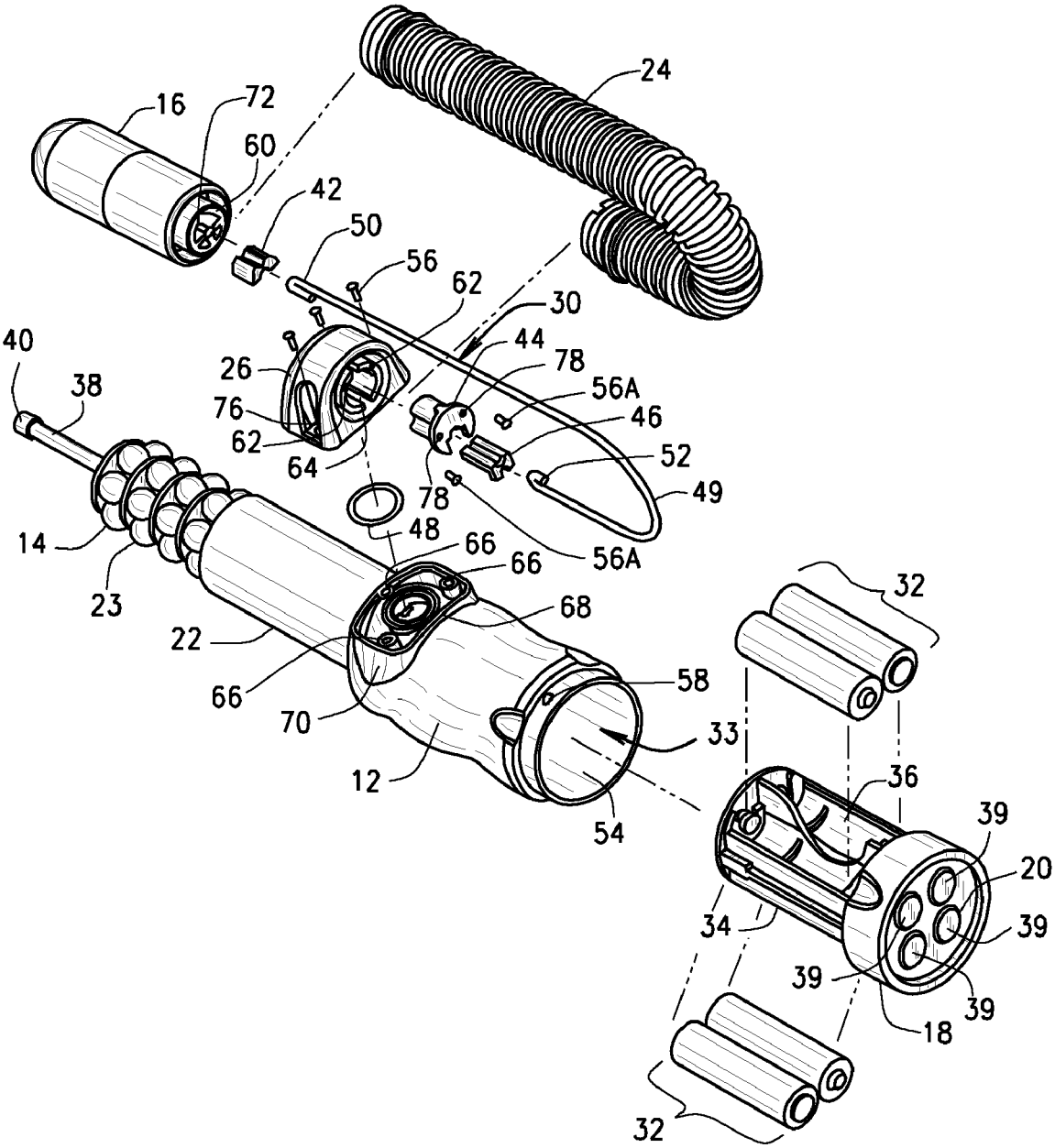
FIG. 3 is an exploded view of the massage apparatus.

Referring to FIGS. 1-3, the main body 12 may include an open end 54 in communication with a chamber 33 adapted to operatively engage the removable battery compartment 18 therein. The removable battery compartment 18 may include a body 34 that defines a plurality of compartments 36 each adapted to receive a respective battery 32 therein for providing power to the massage apparatus 10. In one embodiment, the removable battery compartment 18 may include four compartments 36, however any number of compartments are contemplated. In addition, the main body 12 defines at least one protrusion 58 adapted to engage at least one L-shaped slot (not shown) defined along the internal surface of the removable battery compartment 18 for operatively engaging the main body 12 to the removable battery compartment 18.

As noted above, the removable battery compartment 18 may include a control panel 20 that controls the operation of the massage apparatus 10 when the removable battery compartment 18 is operatively engaged to the main body 12. In one embodiment, the control panel 20 may have four push-buttons 39 that control the respective operations of the squirmy massage actuator 14 and vibration massage actuator 16. In one aspect, the control panel 20 may control the rotational direction of the rod 38, degree of vibration function imparted by the vibration massage actuator 16, and the ON and OFF switches for turning on or off the respective operations of the squirming massage actuator 14 and vibration massage actuator 16. However, switches or push buttons that control other types of operations of the massage apparatus 10 are contemplated.

Referring to FIG. 3, the body 49 of malleable wire 30 may define a distal hook 50 at one end and a proximal hook 52 at the other end of body 49. The boss 72 may define an opening 60 sized and shaped to accommodate a clamping plug 42 adapted to engage the distal hook 50 of the malleable wire 30. As shown, a first plug 44 may be adapted to engage a second plug 46 which collectively engage the proximal hook 52 of malleable wire 30 in a clamping action to the coupling block 26.

The coupling block 26 may be engaged to the main body 12 at a protruded-out boss 70 by fastening screws 56 through respective openings 76 and into bosses 66. An axial side opening 64 may be defined by the coupling block 26 and is sized and shaped to accommodate first plug 44 therein such that the proximal end 52 of malleable wire 30 is anchored to the coupling block 26 through first plug 44. After the first plug 44 is engaged to side opening 64, screws 56A may fasten first plug 44 to coupling block 26 by inserting screws 56A through holes 78 defined by first plug 44 and holes 62 defined by coupling block 26. A slot 68 may be defined by main body 12 and be adapted to receive a sealing element 48 made of a resilient material to provide a water-tight seal between the main body 12 and coupling block 26.

Engagement of the malleable wire 30 between the boss 72 and the coupling block 26, as noted above, permits the casing 31 of the vibration massage actuator 16 to be bent at any orientation and retain that bent orientation relative to the main body 12 once the bending force has been removed from malleable wire 30. As such, the vibration massage actuator 16 may be flexibly connected to the main body 12 such that the orientation of the vibration massage actuator 16 relative to the main body 12 may be readily changed by the user.

It should be understood from the foregoing that, while particular embodiments have been illustrated and described, various modifications can be made thereto without departing from the spirit and scope of the invention as will be apparent to those skilled in the art. Such changes and modifications are within the scope and teaching of this invention as defined in the claims appended hereto.

What is claimed is:

1. A massage apparatus comprising: a main body, said main body being directly engaged with a first massage actuator, said main body being adapted to operatively engage a removable battery compartment, said removable battery compartment providing a means for controlling the operation of the massage apparatus, and a second massage actuator engaged to said main body through a malleable wire, the malleable wire being made of a smooth, linear and solid construction adapted to be bent to any orientation and retain that bent orientation relative to said main body, wherein said main body is engaged to a coupling block, said malleable wire being adapted to engage said coupling block, wherein said malleable wire defines a distal hook and a proximal hook, said distal hook being adapted to be engaged to said massage actuator and said proximal hook being adapted to be engaged to said coupling block, wherein said massage actuator includes a boss, said boss defines an opening, said opening being adapted to engage a clamping plug, wherein said distal hook is adapted to be engaged to said clamping plug for engaging said malleable wire to said massage actuator.

2. The massage apparatus according to claim 1, wherein said malleable wire is encased in a flexible tube.

3. The massage apparatus according to claim 1, wherein said coupling block defines an opening, said opening adapted to be engaged to a first plug, said first plug be adapted to be engaged to a second plug, said first and second plugs collectively engage said proximal hook in a clamping action.

4. The massage apparatus according to claim 1, wherein said removable battery compartment comprises a body that defines a plurality of compartments, each of said plurality of compartments adapted to receive a respective battery therein.

5. The massage apparatus according to claim 1, wherein said removable battery compartment comprises a control panel, said control panel being adapted to control the operation of said massage apparatus.

6. The massage apparatus according to claim 5, wherein said control panel controls the operation of said massage apparatus when said removable battery compartment is operatively engaged to said main body.

7. The massage apparatus according to claim 1, wherein said removable battery compartment is adapted to engage a protrusion defined by said main body when operatively engaging said removable battery compartment to said main body.

8. The massage apparatus according to claim 1, wherein said malleable wire is adapted to be bent to any orientation at room temperature.

9. The massage apparatus according to claim 1, wherein one of said one or more massage actuators is a squirmy massage actuator.

10. A method for using a massage apparatus comprising:

a) providing a massage apparatus comprising a main body directly engaged to at least one massage actuator, said at least one massage actuator being directly engaged to said main body through a malleable wire, said malleable wire being made of a smooth, linear and solid construction adapted to be bent at to any orientation and retain that bent orientation relative to said main body, wherein said main body is engaged to a coupling block, said malleable wire being adapted to engage said coupling block, wherein said malleable wire defines a distal hook and a proximal hook, said distal hook being adapted to be engaged to said massage actuator and said proximal hook being adapted to be engaged to said coupling block, wherein said massage actuator includes a boss, said boss defines an opening, said opening being adapted to engage a clamping plug, wherein said distal hook is adapted to be engaged to said clamping plug for engaging said malleable wire to said massage actuator, b) applying a force to said malleable wire in order to bend said malleable wire to any bent orientation; and c) removing said force from said malleable wire such that said malleable wire retains said bent orientation.

* * * * *

UNITED STATES PATENT AND TRADEMARK OFFICE

CERTIFICATE OF CORRECTION

PATENT NO. : 7,803,126 B2
APPLICATION NO. : 11/311768
DATED : September 28, 2010
INVENTOR(S) : Simon Siu Man Nan It is certified that error appears in the above-identified patent and that said Letters Patent is hereby corrected as shown below:

Column 4, line 65 (Claim 3): “be adapted” should read -- being adapted --

Column 6, line 7 (Claim 10): “at to” should read -- to --

Signed and Sealed this
Seventh Day of August, 2012

David J. Kappos

David J. Kappos
*Director of the United States Patent and Trademark Office*